United States Patent [19]

Borgen

[11] Patent Number: 4,629,190

[45] Date of Patent: Dec. 16, 1986

[54] HOCKEY STICK HAVING ARCUATELY BENT SHAFT

[76] Inventor: Michael S. Borgen, 1029 W. Dwelle, Lake City, Minn. 55041

[21] Appl. No.: 601,302

[22] Filed: Apr. 17, 1984

[51] Int. Cl.[4] ..... A63B 59/14

[52] U.S. Cl. ..... 273/67 A

[58] Field of Search ..... 273/73 J, 75, 67 R, 273/67 A, 67 D, 67 DA, 67 DB, 67 C, 81.3, 80 C, 167 G, 326; D21/210–214

[56] References Cited

U.S. PATENT DOCUMENTS

| | | | |
|---|---|---|---|
| 676,736 | 6/1901 | Dean . | |
| 1,183,473 | 5/1916 | McNiece . | |
| 1,549,971 | 11/1924 | Hall . | |
| 1,657,473 | 1/1928 | Howard | 273/81.3 |
| 3,679,209 | 7/1972 | Wexstaff . | |
| 4,200,479 | 4/1980 | Ardell et al. | 273/67 A |
| 4,358,113 | 11/1982 | McKinnon et al. | 273/67 A |

FOREIGN PATENT DOCUMENTS

| | | | |
|---|---|---|---|
| 373438 | 8/1927 | Canada | 273/67 A |
| 922750 | 3/1973 | Canada | 273/67 A |
| 87471 | 7/1936 | Sweden | 273/67 A |
| 24798 | of 1910 | United Kingdom | 273/326 |
| 419317 | 11/1934 | United Kingdom | 273/81.3 |

*Primary Examiner*—Richard C. Pinkham
*Assistant Examiner*—Matthew L. Schneider
*Attorney, Agent, or Firm*—Merchant, Gould, Smith, Edell, Welter & Schmidt

[57] ABSTRACT

A hockey stick is disclosed. The hockey stick has a conventional blade, but a shaft bent in a plane substantially normal to the plane of the blade. The shaft is bent concavely toward the player thereby enhancing the comfort and effectiveness of both hands during forehead shots.

4 Claims, 5 Drawing Figures

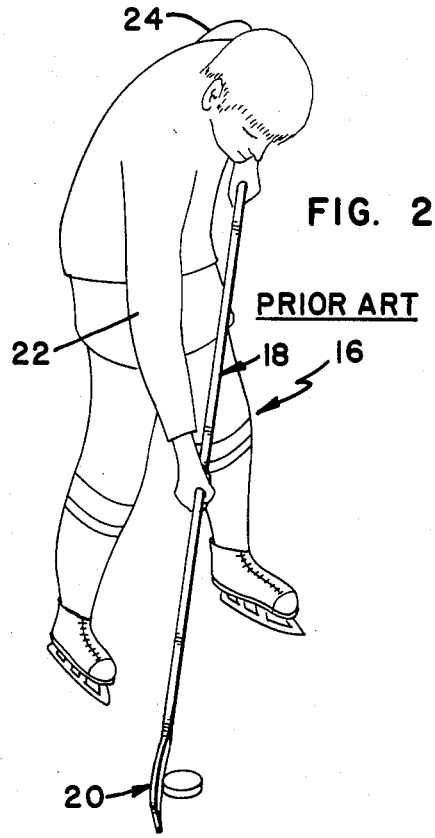
FIG. 2
PRIOR ART
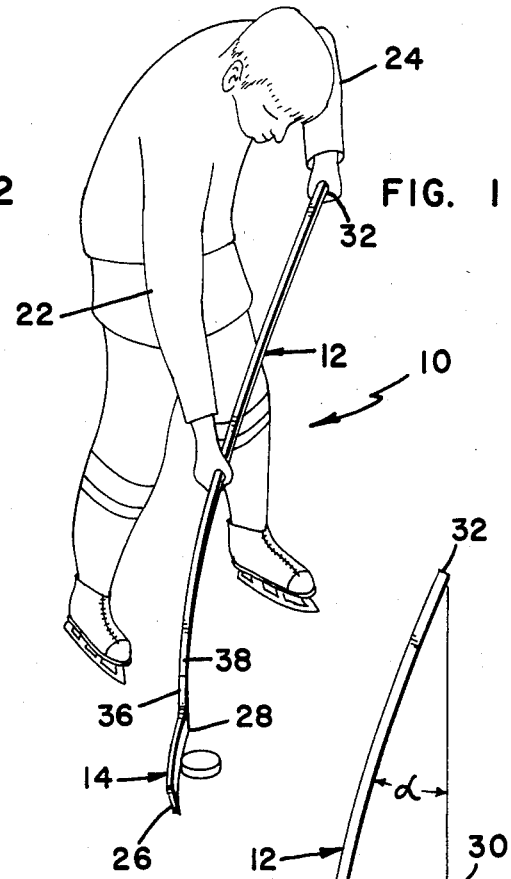
FIG. 1
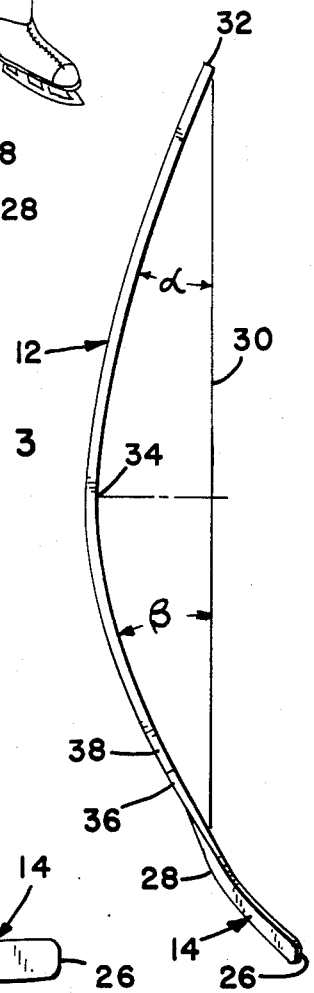
FIG. 3
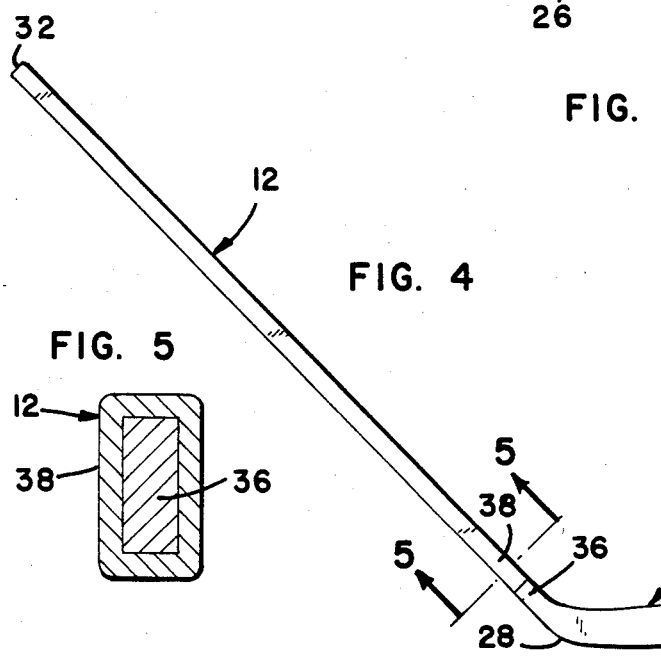
FIG. 4
FIG. 5

HOCKEY STICK HAVING ARCUATELY BENT SHAFT

FIELD OF THE INVENTION

The present invention relates to an improvement in the stick used in the winter sport of hockey.

BACKGROUND OF THE INVENTION

Hockey is a well known winter sport wherein ice skaters use a stick to carry a puck along ice and to shoot the puck into a net. A number of different types of shots are well known to hockey players. Such shots include the wrist shot, the snap shot, the slap shot and the backhand shot. Each of the shots is more appropriate than the others in certain types of game situations. The choice of a particular shot is made in order to propel the puck toward the net as fast as possible considering the proximity of opposing players and the position and dexterity of the shooting player. The purpose of propelling a puck with as much speed as possible is that the puck must get past the goalie before he has time to react and stop the puck from entering the net.

Present hockey sticks have straight shafts and generally slightly curved blades. The curvature of the blade is helpful for carrying a puck down the ice and for lifting the puck off the ice as a result of a shooting movement. In general, sticks are made from wood, although some have aluminum shafts. Bigger and stronger hockey players have the power to bend the shaft of a hockey stick during shooting, especially a slap shot. As the shaft bends away from the puck, less impact force than might otherwise be possible is applied to the puck. Consequently, the puck moves at a somewhat slower speed and has a somewhat lower chance of beating or getting by a goalie. In addition, straight-shafted sticks require a player to hold the stick in a somewhat awkward position while shooting. In spite of these problems, hockey sticks have not been altered significantly for decades.

SUMMARY OF THE INVENTION

The present invention is directed to a hockey stick which includes a blade and a shaft wherein the shaft includes a mechanism for allowing the shaft to straighten during a forehand shot, namely a wrist shot, a snap shot or a slap shot.

In a more particular embodiment, the hockey stick of the present invention includes a shaft having an arcuate bend between the top and bottom ends. The bend is in a plane substantially normal or perpendicular to the blade. The bend is in a direction coming toward the player. In this way, as the player takes a forehand shot, the shaft may bend, but in doing so, it bends toward a straighter configuration. In this way, the blade still makes full contact with the puck, and, actually, the shaft may exhibit substantial spring thus propelling the puck at a faster than otherwise possible speed.

An additional advantage of the shape of the present stick is that the stick is more comfortably held by the player. That is, the player's lower hand is closer to the body which is a more comfortable position and provides for greater stick control. Furthermore, when a forehand shot is taken, both hands may more easily apply a torquing force so as to rotate the stick more rapidly and thus, again, strike the puck to propel it with higher speed.

These advantages and other objects obtained by this invention are further explained and may be better understood by reference to the drawings and descriptive matter presented hereinafter. Although a preferred embodiment of the invention is illustrated, it is understood that the embodiment is only representative of the invention as detailed in the claims.

BRIEF DESCRIPTION OF THE DRAWINGS

FIG. 1 is a perspective view of a hockey player ready to shot a puck with a hockey stick in accordance with the present invention;

FIG. 2 is a perspective view similar to FIG. 1 but showing a prior art stick;

FIG. 3 is an elevational view from the toe end of a hockey stick in accordance with the present invention; and FIG. 4 is an elevational view from the rear side of the stick of FIG. 3; and FIG. 5 is a cross-sectional view, taken along line 5—5, of FIG. 4.

DETAILED DESCRIPTION OF THE PRESENT INVENTION

Referring now to the drawings wherein like reference numerals designate identical or corresponding parts throughout the several views, and more particularly to FIG. 1, a hockey stick in accordance with the present invention is designated generally by the numeral 10. Stick 10 includes a shaft 12 and a blade 14. The shaft 12 and blade 14 may be an integral unit or may be fastened together as explained hereinafter.

Stick 10 is contrasted with a hockey stick 16 exemplary of the prior art as shown in FIG. 2. Stick 16 also has a shaft 18 and a blade 20 which may or may not be an integral unit. Shaft 18 is straight, although blade 20 may or may not have a curvature. FIG. 2 shows a hockey player in the act of making a forehand shot. Although not shown, the blade ordinarily contacts the ice four to ten inches behind the puck. On contact with the ice, the force being exerted by arm 22 of the hockey player causes shaft 18 to deflect and, consequently, can result in a smaller than otherwise would be the case force being applied to the puck. In addition, note the left arm 24 of the hockey player. Arm 24 is tucked very close to the body, and since the left hand is essentially the fulcrum for stick 16, the left arm applies only a small force to the stick during the shot. The position of left arm 24 is generally awkward and uncomfortable.

As shown in FIGS. 3 and 4, stick 10 includes shaft 12 bent in a plane substantially perpendicular to the plane generally passing through the toe 26 and heel 28 of blade 14. The bend in shaft 12 preferably reaches a point 34 farthest from a chord 30 extending between the top end 32 of shaft 12 and the heel 28 of blade 14 at a location somewhat greater than half the length of shaft 12 as measured from top end 32. Point 34 may vary within a range while yet allowing stick 10 to retain its effectiveness. Point 34 should, however, be less than 70% of the length of shaft 12 as measured from top end 32 and preferably is located within a range of 55–60% of the length of shaft 12 as measured from top end 32.

The bend in shaft 12 is substantially normal to blade 14 and is such that shaft 12 is inclined by an angle $\alpha$ preferably in a range of 4 to 16 degrees from chord 30 at the top end 32 of shaft 12 and is inclined by an angle $\beta$ preferably in a range of 5 to 20 degrees at the bottom end of shaft 12 with respect to chord 30.

Although specification of angles $\alpha$ and $\beta$ and the relative location of point 34 determines the bend in shaft 12, in a situation where shaft 12 is separate from blade 14, it is preferable for the bottom approximately eight inches of shaft 12 to be straight. Then the straight portion 36 is a part of blade 14 as extending upwardly from heel 28. In addition, a mating straight portion 38 is located near the bottom end of shaft 12 to overlap straight portion 36. In this way, the lower end of shaft 12 may be tubular to receive the straight portion 36 of blade 14 (or conversely, of course, the straight portion 36 of blade 14 may be tubular to receive shaft 12). An adhesive is used to hold the two parts together or some other mechanical mechanism such as a screw may be used. The length of the straight portion is preferably in the range of seven to nine inches.

It is important to realize that not all sticks of the present invention have exactly the same curvatures. It is well known that a stick should have sufficient length to reach somewhere between the chin and nose of the hockey player when he/she is standing on skates, and the shaft 12 of the stick is rising substantially vertically with the toe 26 resting on the ice. Thus, young hockey players or short hockey players have fairly short sticks, while older or taller hockey players have longer sticks. Hockey players of different heights can have comparable shaft curvatures, but with respect to one another, the curvatures will look quite different. It is likely, however, that younger hockey players will learn to use the present stick more easily by having lesser curvatures, i.e., lesser values of angles $\alpha$ and $\beta$, while older hockey players and especially defensemen will find greater curvatures, i.e. greater angles $\alpha$ and $\beta$, to be advantageous.

The real advantage of the present invention is best understood by observing the hockey player of FIG. 1. As the player addresses the puck, he is able to pull left arm 24 toward himself while swinging and extending right arm 22. Thus, not only is the shaft 12 designed to encourage straightening during a forehand shot, but the pivot is effectively moved from the left hand to some point between the left and right hands thereby making both hands and arms useful force applying mechanisms for moving stick 10 during a shot.

Although the details of structure and function, as well as advantages, have been given for the preferred embodiment, it is understood that the present disclosure is exemplary. Changes may be made. It is understood, however, that changes made, especially in matters of shape, size and arrangement, to the full extent extended by the general meaning of the terms in which the appended claims are expressed, are within the principle of the invention.

What is claimed is:

1. A hockey stick, comprising:

a blade having a heel; and a shaft having a top end and means for connecting a bottom end to said blade, said shaft having an arcuate bend between the top and bottom ends, said bend being in a plane substantially normal to said blade, said bend reaching its farthest point from a chord extending between the top end of said shaft and the heel of said blade at a location between $33\frac{1}{3}$ percent and 70 percent of the length of the shaft as measured from the top end of said shaft, said shaft being substantially straight for a length of approximately 7 to 9 inches extending from the heel of said blade toward the top end of said shaft.

2. The hockey stick in accordance with claim 1 wherein said connecting means includes an end of said blade fitting within a tubular member, said tubular member being the straight length of said shaft.

3. A hockey stick, comprising:

a blade having a toe and heel, said blade being generally aligned along a first plane pressing through said toe and heel; and a shaft having a top end, said shaft having an arcuate bend in a second plane nearly perpendicular to said first plane, said bend reaching its farthest point from a short extending between the top end of said shaft and the heel of said blade at a location between 55 and 60 percent of the length of the shaft as measured from the top end, the angle formed between the arcuate bend of said shaft and said chord, at the top end of said shaft is between 4 and 16 degrees and the angle formed between the arcuate bend of said shaft and said chord, at the bottom end of said shaft is between 5 and 20 degrees.

4. A hockey stick, comprising:

a blade having a toe and heel, said blade being generally aligned along a first plane passing through said toe and heel; and a shaft having a top end, said shaft having an arcuate bend in a second plane nearly perpendicular to said first plane, said bend reaching its farthest point from a chord extending between the top end of said shaft and the heel of said blade at a location between $33\frac{1}{3}$ and 70 percent of the length of the shaft as measured from the top end, the angle formed between the arcuate bend of said shaft and said chord, at the top end of said shaft is less than 16 degrees and the angle formed between the arcuate bend of said shaft and said chord, at the bottom end of said shaft is less than 20 degrees, said hockey stick being substantially straight for approximately seven to nine inches extending from the heel of said blade toward the top end of said shaft.

* * * * *